United States Patent [19]

Ayers

[11] Patent Number: 4,797,117

[45] Date of Patent: Jan. 10, 1989

[54] MARINE ELECTRICAL PLUG

[75] Inventor: Ray R. Ayers, Houston, Tex.

[73] Assignee: Shell Oil Company, Houston, Tex.

[21] Appl. No.: 452,590

[22] Filed: Dec. 23, 1982

[51] Int. Cl.[4] ..... H01R 4/64

[52] U.S. Cl. ..... 439/200; 439/464; 439/271

[58] Field of Search ..... 339/94, 60, 115, 117, 339/103; 174/77 R, 93

[56] References Cited

U.S. PATENT DOCUMENTS

| | | | |
|---|---|---|---|
| 2,700,140 | 1/1955 | Phillips | 339/94 M |
| 3,026,495 | 3/1962 | Quackenbush | 339/103 |
| 3,054,847 | 9/1962 | Colbert | 174/93 |
| 3,096,134 | 7/1963 | Kanarek | 339/150 |
| 3,113,999 | 12/1963 | Heikkinen | 174/151 |
| 3,124,405 | 3/1964 | Massa | 339/60 |
| 3,158,420 | 11/1964 | Olson et al. | 339/96 |
| 3,241,095 | 3/1966 | Phillips | 339/94 M |
| 3,266,009 | 8/1966 | Jensen et al. | 339/94 M |
| 3,278,885 | 10/1966 | Klinger | 339/60 |
| 3,324,449 | 6/1967 | McLoad | 339/117 |
| 3,339,632 | 9/1967 | Lewis | 166/0.6 |
| 3,377,422 | 4/1968 | Trimble et al. | 174/93 |
| 3,410,950 | 11/1968 | Freudenberg | 174/84 |
| 3,430,187 | 2/1969 | DeMan et al. | 339/103 |
| 3,432,612 | 3/1969 | Spiegel et al. | 174/88 |
| 3,487,353 | 12/1969 | Massa | 339/89 |
| 3,489,987 | 1/1970 | Niskin | 339/49 |
| 3,522,576 | 8/1970 | Cairns | 339/91 |
| 3,537,062 | 10/1970 | Niskin | 339/60 |
| 3,546,657 | 12/1970 | Cook | 339/60 |
| 3,665,368 | 5/1972 | Ellis | 339/60 R |
| 3,705,950 | 12/1972 | Jirka et al. | 174/77 R |
| 3,725,846 | 4/1973 | Strain | 339/61 R |
| 3,725,852 | 4/1973 | Blanchet | 339/198 V |
| 3,729,699 | 4/1973 | Briggs et al. | 339/42 |
| 3,784,959 | 1/1974 | Horton | 339/60 M |
| 3,816,641 | 6/1974 | Iversen | 174/76 |
| 3,821,690 | 6/1974 | Small | 339/75 R |

OTHER PUBLICATIONS

Kintec, Incorporated (FITA) LP-Series (CP) Field Installable and Testable Assembly, FIGS. 1 and 2.

*Primary Examiner*—David Pirlot

[57] ABSTRACT

An end terminal is provided for an underwater electrical cable, the terminal having a booted seal and being field installable and repairable.

7 Claims, 1 Drawing Sheet

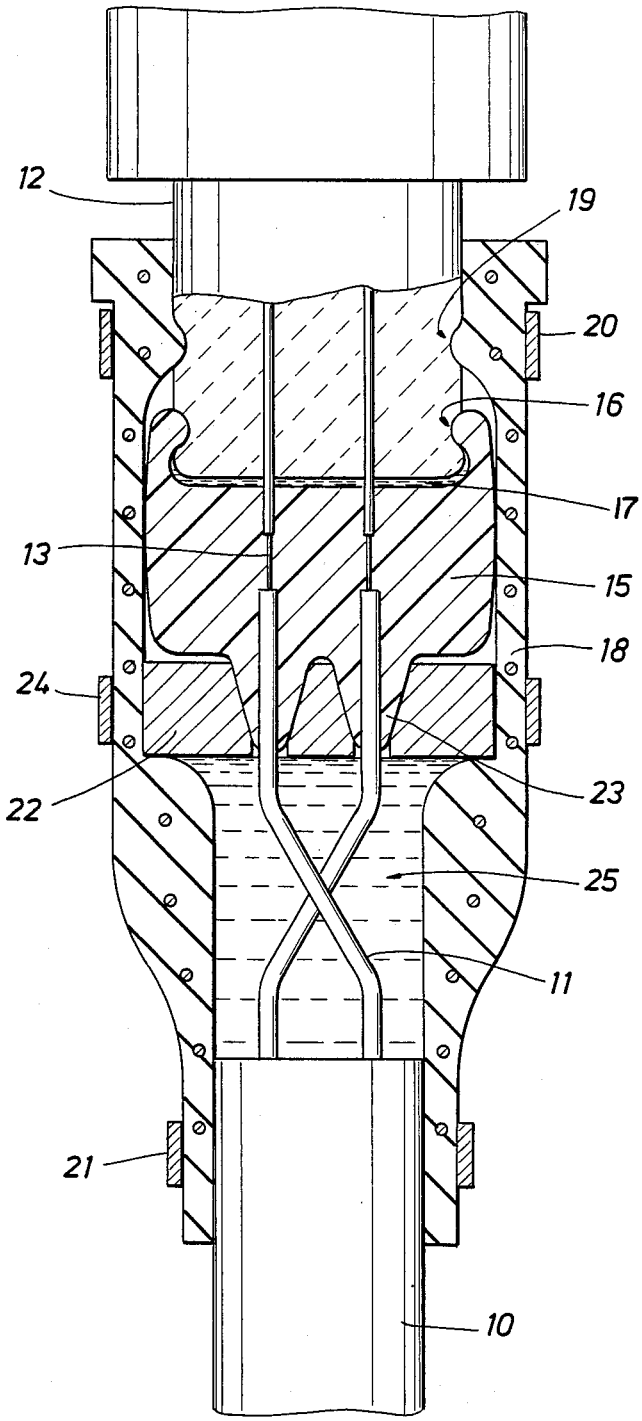
12
19
20
16
17
13
15
18
24
22
23
25
11
21
10

MARINE ELECTRICAL PLUG

BACKGROUND OF THE INVENTION

Underwater electrical cables cause major problems when they begin to leak. One of the greatest sources of leakage is in the end terminations, or "plugs". The primary water sealing means in an underwater cable should be the insulation encapsulating the strands of the individual conductors. Oftentimes the art considers the outer jacket of the bundle of conductors to be the primary sealing means, but it is actually a secondary sealing means. The major problem is that it is difficult to effect a seal between the insulating material and the plug. One of the best insulating materials for the conductors is an ethylene-propylene copolymer which does not readily bond to other sealing materials. Even commonly used epoxy pottings do not readily bond to it. One good solution to this sealing problem is to use a rubber "boot" which seals along the outside of the multiple insulated conductors and the plug body containing solder pins. Silicone grease is applied to the boot cavity after soldering the conductors to the pins, effectively sealing the area from water intrusion. In this connection, reference may be had to the field installable and testable connectors of Kintec, Inc. Such connectors work well, but are bulky, stiff, heavy and expensive. Additionally, such connectors work best for deep subsea application where the best seals are hydrostatically pressure energized. Other smaller and more flexible plugs which do not use such a boot for sealing, instead use an epoxy potting material to seal the joint. The problem with this plug is that epoxies tend to contract upon curing, leaving a channel for water to seep in, particularly if the connection is subject to cyclic flexing.

In marine seismic exploration operations, underwater electrical plugs are needed to connect power and instrumentation conductors to air guns. These guns are used as a source to obtain acoustic reflections from the seafloor. Typically, these guns are fired every 10 to 15 seconds and the impulsive pressure waves produced are quite strong. Electrical "jumper" cables used for this application must withstand a great deal of structural abuse, and normally they do not last long before developing leaks. The first-mentioned booted plug is too stiff and massive to have reasonable structural integrity to withstand such cyclic impulsive loadings. Typically, structural elements exposed to such blast elements will not last long if they are not flexible. Further, the pressure waves produced by the guns have negative (vacuum) parts, making the boots "pump". There is consequently a greater possibility that water will intrude the boot during fluctuating pressure then during static hydrostatic pressure.

Accordingly, it is the primary purpose of the invention disclosed hereinafter to provide an end terminal for an underwater electrical cable which solves these problems and which can be utilized in marine seismic operations as underwater electrical plugs which are needed to connect power and instrumentation conductors to air guns. Another purpose of the present invention is to improve the inner boot sealing capability of the end terminal, to make the connection more flexible, and to attenuate pressure loadings on the insulated conductors.

Other purposes, advantages and features of the invention will be apparent to one skilled in the art upon reviewing the following disclosure.

Applicant is not aware of any prior art references which, in his judgment as one skilled in the art of marine seismic underwater electrical plugs, would anticipate or render obvious the novel end terminal of the instant invention; however, for the purposes of fully developing the background of the invention and establishing the state of the requisite art, the following references are set forth: two diagrams of plugs available from KINTEC, Inc., 9540 Cozycroft Avenue, Chatsworth, Calif. 91311, showing respectively, FITA and MLD LP series CR plugs; U.S. Pat. Nos. 3,096,134; 3,113,999; 3,124,405; 3,158,420; 3,278,885; 3,324,449; 3,339,632; 3,410,950; 3,430,187; 3,432,612; 3,487,353; 3,489,987; 3,522,576; 3,537,062; 3,546,657; 3,665,368; 3,821,690; 3,725,846; 3,725,852; 3,729,699; 3,816,641; and 3,784,959.

REFERENCE TO RELATED APPLICATION

This application is relevant to application Ser. No. 443,000 filed Nov. 19, 1982.

BRIEF DESCRIPTION OF THE DRAWING

FIG. 1 provides a cross sectional view of the end terminal of the present invention.

SUMARY OF THE INVENTION

The present invention provides an end plug, male or female, for an underwater electrical cable, which plug includes an electrical contact insert; at least one conductive pin extending from the insert; at least one insulated conductor extending from the electrical cable and into conductive contact with the conductive pin; a first non-conductive material disposed surrounding the locale of the conductive contact of the conductive pin and the insulated conductor; a seal boot at least partially surrounding the non-conductive material, this insulated conductor extending through a nipple of the seal boot; a preloader abutting the seal boot and having an aperture through which the nipple is wedged, the preloader binding and sealing the nipple to the insulted conductor; a second non-conductive material disposed surrounding the insulated conductor adjacent the preloader; and an outer boot at least partially surrounding the non-conductive materials, seal boot and preloader.

DESCRIPTION OF THE PREFERRED EMBODIMENTS

In accordance with the present invention, an end plug for an underwater electrical cable is provided which uses a booted seal and an outer structural boot. Such a plug is shown in FIG. 1. The key feature of this design is a preloader which seals the seal boot to insulated conductors extending therethrough. The plug is preferably used in marine seismic exploration operations which are needed to connect power and instrumentation conductors to air guns, and as such serve to attenuate the incoming blast pressure wave, reducing the loading on the conductors. The effects of the preloader used as hereinafter described are to improve the inner boot sealing capability, make the connector field installable and repairable, and in addition, make the plug reasonably inexpensive to fabricate.

Referring specifically to FIG. 1, there is provided a more specific disclosure of the invention wherein there is shown an electrical cable 10 which includes an outer jacket and insulated conductors 11. At the other end of the end terminal of the present invention there is an electrical contact insert or pin body 12 from which extends pins 13 having a pointed end which connects with insulated conductors 11. The electrical connection between pins 13 and conductors 11 may be made by soldering, etc. A seal boot 15 serves not only to center and align the conductors 11 but also functions to partially encapsulate the locale wherein conductive contact is made between the conductive pins 13 and the insulated conductors 11. A non-conductive material 17 such as silicone grease or other viscous, non-conductive fluid is disposed surrounding this area of contact and is backed up on one side by insert 12. The seal boot 15 fits into a recess 16 of the insert 12 and is held in place by an outer structural boot 18 which fits about the lip of the seal boot 15 and secures it to the insert 12. The outer structural boot 18 may be reinforced with steel rings, if required, and is preferably of rubber or the like as is the seal boot 15. A steel clamp 20 can be utilized to attach the outer boot 18 to the insert 12 at recess 19. The opposite end of outer boot 18 is attached to electrical cable 10 by means of a steel clamp 21. A preloader 22 is employed to seal nipples 23 of boot 15 to conductors 11, and clamp 24 is employed to secure the sealing position of the preloader. A second non-conductive material 25 is disposed surrounding the insulated conductors adjacent the preloader.

What is claimed is:

1. A plug, male or female, for an underwater electrical cable comprising:

an electrical contact insert;

at least one conductive pin extending from said electrical contact insert;

at least one insulated conductor extending from said electrical cable and into conductive contact with said conductive pin;

a first non-conductive material disposed surrounding the locale of said conductive contact of said conductive pin and said insulated conductor;

a seal boot at least partially surrounding the first non-conductive material, the insulated conductor extending through a nipple of the seal boot, the first non-conductive material being surrounded on one side by the electrical contact insert and on the other side by the seal boot;

a preloader abutting the seal boot and having an aperture through which the nipple is wedged, the preloader binding and sealing the nipple to the insulated conductor;

a second non-conductive material disposed surrounding the insulated conductor adjacent the preloader; and an outer boot at least partially surrounding the non-conductive materials, seal boot and preloader, the seal boot forming a cup and a rim of the cup being secured between a recess in the insert and the outer boot.

2. The plug of claim 1 wherein the preloader is clamped into position adjacent the seal boot by a clamp around the outer boot.

3. The plug of claim 1 wherein the preloader is held between the seal boot and an inside shoulder of the outer boot.

4. The plug of claim 1 wherein the seal boot positions the insulated conductors in a central, axially aligned location.

5. The plug of claim 1 wherein the seal boot and outer boot are rubber, the non-conductive materials are silicone grease.

6. a plug, male or female, for an underwater electrical cable comprising:

an electrical contact insert;

at least one conductive pin extending from said insert;

at least one insulated conductor extending from said electrical cable and into conductive contact with said conductive pin;

a first non-conductive material disposed surrounding the locale of said conductive contact of said conductive pin and said insulated conductor;

a seal boot at least partially surrounding the first non-conductive material, the insulated conductor extending through a nipple of the seal boot;

a preloader abutting the seal boot and having an aperture through which the nipple is wedged, the preloader binding and sealing the nipple to the insulated conductor;

a second non-conductive material disposed surrounding the insulated conductor adjacent the preloader and being surrounded on one side by the preloader and on the other side by the electrical cable; and an outer boot at least partially surrounding the non-conductive materials, seal boot and preloader, one end of the outer boot being clamped at the location of a recess in the insert member.

7. The plug of claim 6 wherein the other end of the outer boot is clamped to the electrical cable.

* * * * *